US012349794B1

(12) United States Patent
Zou

(10) Patent No.: US 12,349,794 B1
(45) Date of Patent: Jul. 8, 2025

(54) DOLL STORAGE RACK CAPABLE OF CHANGING SHAPES AND ITS USAGE METHOD

(71) Applicant: Chungen Zou, Ji'an (CN)

(72) Inventor: Chungen Zou, Ji'an (CN)

( * ) Notice: Subject to any disclaimer, the term of this patent is extended or adjusted under 35 U.S.C. 154(b) by 0 days.

(21) Appl. No.: 18/970,218

(22) Filed: Dec. 5, 2024

(30) Foreign Application Priority Data

Nov. 6, 2024 (CN) ..... 202411577036.6

(51) Int. Cl.
*A47B 47/02* (2006.01)
*A47B 96/20* (2006.01)

(52) U.S. Cl.
CPC ..... *A47B 96/20* (2013.01); *A47B 2096/209* (2013.01)

(58) Field of Classification Search
CPC ..... A47B 47/027; A47B 47/028; A47B 96/20; A47B 2096/209
USPC ..... 312/3, 204
See application file for complete search history.

(56) References Cited

U.S. PATENT DOCUMENTS 4,416,493 A * 11/1983 Sumner ..... A63H 3/52 D6/567
4,821,893 A * 4/1989 Wyatt ..... F16B 7/22 D34/21
D302,774 S * 8/1989 Murphy ..... D9/425
4,954,384 A * 9/1990 Hartwell ..... A47B 71/00 52/3
5,072,998 A * 12/1991 Oh ..... A63H 3/16 446/268
5,111,944 A * 5/1992 Ostermeyer ..... A47F 5/0025 211/133.1
5,192,092 A * 3/1993 DiBenedetto ..... B65F 1/141 280/654
5,464,214 A * 11/1995 Griffin ..... A63H 33/00 312/7.2
5,564,209 A * 10/1996 Zagnoli ..... G06F 1/1607 40/594
D384,855 S * 10/1997 Robertson ..... D25/16
5,762,213 A * 6/1998 Heneveld, Sr. ..... A47B 88/402 211/187

(Continued)

FOREIGN PATENT DOCUMENTS

CN 211380352 U 9/2020
CN 213215946 U 5/2021
CN 220255991 U 12/2023

*Primary Examiner* — James O Hansen
(74) *Attorney, Agent, or Firm* — George D. Morgan

(57) ABSTRACT

The present invention belongs to the technical field of storage racks. It also discloses a doll storage rack capable of changing shapes and its usage method. The doll storage rack includes two main frames. The two main frames are equipped with a top connecting rod, a first intermediate connecting rod, a second intermediate connecting rod, a third intermediate connecting rod and a fourth intermediate connecting rod. The number of the first intermediate connecting rod, the second intermediate connecting rod, the third intermediate connecting rod and the fourth intermediate connecting rod is two respectively, and they are symmetrical about the center of the main frame. A hidden placing plate, an upper placing plate, various types of placing plates and a bottom placing plate are arranged between the two main frames.

7 Claims, 7 Drawing Sheets

(56) References Cited

U.S. PATENT DOCUMENTS

| | | | | |
|---|---|---|---|---|
| 5,894,878 | A * | 4/1999 | Morgan | G06F 1/1603 160/354 |
| 6,402,269 | B1 * | 6/2002 | Roth | G06F 1/1601 312/208.3 |
| 6,709,078 | B2 * | 3/2004 | Johnson | A47B 81/06 248/924 |
| D620,010 | S * | 7/2010 | Chiu | D14/448 |
| 2004/0206013 | A1 * | 10/2004 | Berg | A01G 9/16 52/63 |
| 2005/0088064 | A1 * | 4/2005 | Jacklin | A47B 43/04 312/265.4 |
| 2006/0076856 | A1 * | 4/2006 | Kim | A47B 96/00 312/204 |
| 2020/0346814 | A1 * | 11/2020 | Gonzalez Olmos | B65D 5/029 |

* cited by examiner

DOLL STORAGE RACK CAPABLE OF CHANGING SHAPES AND ITS USAGE METHOD

CROSS-REFERENCE TO RELATED APPLICATIONS

The application claims priority to Chinese patent application No. 2024115770366, filed on Nov. 6, 2024, the entire contents of which are incorporated herein by reference.

TECHNICAL FIELD

The present invention belongs to the technical field of storage racks capable of changing shapes, specifically a doll storage rack capable of changing shapes and its usage method.

BACKGROUND

In the current children's furniture market, storage racks, as an indispensable part of children's rooms, play a crucial role. They are not merely a simple storage space but also a key element in shaping the living order and personalized space for children. These storage racks are carefully designed to meet the storage needs of toys, books, clothes and various other items in children's daily lives, ensuring that children's rooms are both neat and orderly and full of childish fun.

The common children's storage racks on the market currently are relatively single in functional design. They only provide basic storage functions and lack independent storage spaces, resulting in low storage efficiency and often requiring parental intervention to store items in an orderly manner. In addition, the current children's storage racks also have deficiencies in terms of aesthetics. Most children's storage racks adopt simple shape and color designs, lacking personalized customization options and being unable to coordinate with the overall style of children's rooms to jointly create a warm, lively and educational growth environment. For this reason, we provide a doll storage rack capable of changing shapes and its usage method to solve the above problems.

SUMMARY

To solve the problems put forward in the above-mentioned background technology, the present invention provides a doll storage rack capable of changing shapes and its usage method, which has the advantages of being able to store small items and being able to change the shape of the storage rack according to children's preferences.

To achieve the above purposes, the present invention provides the following technical solutions: A doll storage rack capable of changing shapes includes two main frames. The two main frames are equipped with a top connecting rod, a first intermediate connecting rod, a second intermediate connecting rod, a third intermediate connecting rod and a fourth intermediate connecting rod. The number of the first intermediate connecting rod, the second intermediate connecting rod, the third intermediate connecting rod and the fourth intermediate connecting rod is two respectively, and they are symmetrical about the center of the main frame. A hidden placing plate, an upper placing plate, various types of placing plates and a bottom placing plate are arranged between the two main frames. A reinforcing frame is installed on the upper surface of the hidden placing plate.

Two multi-functional storage mechanisms are placed on the upper surface of the bottom placing plate, and the multi-functional storage mechanism includes a cover plate.

Doll covers are sleeved on the outer surfaces of the two main frames.

Doll foot-shaped patterns are pasted on the outer surface of the cover plate.

Preferably, two vertical partition plates are fixedly connected to the upper surface of the various types of placing plates. Both of the two vertical partition plates are fixedly connected to the bottom surface of the upper placing plate. Two bottom feet are fixedly connected to the bottom surfaces of the two main frames.

Preferably, the multi-functional storage mechanism further includes an octagonal storage cloth and a supporting ring. Eight lifting hard boards are installed inside the octagonal storage cloth. The bottom surface of the octagonal storage cloth is fixedly connected with a bearing cloth. The bottom surface of the cover plate is fixedly connected with a cloth sleeve. The inner wall of the cloth sleeve is in contact with the outer surface of the octagonal storage cloth. The multi-functional storage mechanism also includes a supporting ring. The supporting ring is placed on the upper surface of the bearing cloth, and the bottom surface of the supporting ring is fixedly connected with a bottom supporting plate.

Preferably, the doll cover is a teddy bear coat, the doll foot-shaped pattern is teddy bear footprints, and the teddy bear coat is connected with a teddy bear face mask through magnetic blocks.

Preferably, the doll cover is a piglet coat, the doll foot-shaped pattern is piglet footprints, and the piglet coat is connected with a piglet face mask through magnetic blocks.

Preferably, the doll cover is a puppy coat, the doll foot-shaped pattern is puppy footprints, and the puppy coat is connected with a puppy face mask through magnetic blocks.

The present invention also provides a usage method of the doll storage rack capable of changing shapes, which includes the following steps:

S1: Firstly, sleeve the teddy bear coat on the outer surfaces of the two main frames, fasten it tightly with Velcro, align the magnetic blocks connected between the teddy bear coat and the teddy bear face mask, and then place the multi-functional storage mechanism with the teddy bear footprint pattern on the bottom placing plate, thus completing the basic usage of the device.

S2: Users can sit on the upper surface of the cover plate to read. By removing the cover plate from the outer surface of the octagonal storage cloth, sundries can be placed inside the octagonal storage cloth.

S3: Remove the cover plate from the outer surface of the octagonal storage cloth, then take out the supporting ring from inside the octagonal storage cloth, and press the opposite edges of any symmetrical sides of the octagonal storage cloth relatively, so that the octagonal storage cloth can be folded and stored, saving space when not in use.

S4: Tear off the Velcro connecting the teddy bear coat, then separate the magnetic blocks between the teddy bear face mask and the teddy bear coat, remove the teddy bear coat from the outside of the two main frames, take the piglet coat or the puppy coat and sleeve it on the outer surfaces of the two main frames, and replace the cover plate on the outer surface of the octagonal storage cloth with one that has the corresponding piglet footprint or puppy footprint pattern, thus completing the shape change and enhancing the ornamental value of the storage rack.

The beneficial effects of the present invention are as follows:

1. Users can replace the doll covers sleeved on the outer surface of the main frames according to children's preferences, thereby changing the shape of the storage rack and enhancing the aesthetic level of the overall living environment. Moreover, the multi-functional storage mechanism can conveniently store small items such as children's toys. The multi-functional storage mechanism can also serve as a children's seat stool when children are playing, which is relatively convenient to use.

2. The main frames are designed with ergonomic dimensions, rounded corners without sharp angles and a safe and stable structural design to ensure the safety and comfort of children during use.

3. The multi-functional storage mechanism can store children's supplies and can also serve as a children's bench, enabling children to interact and adding fun when using the device.

In the figures: 1. Main frame; 2. Top connecting rod; 3. First intermediate connecting rod; 4. Hidden placing plate; 5. Second intermediate connecting rod; 6. Upper placing plate; 7. Third intermediate connecting rod; 8. Various types of placing plates; 9. Vertical partition plate; 10. Fourth intermediate connecting rod; 11. Bottom placing plate; 12. Bottom foot; 13. Reinforcing frame; 14. Multi-functional storage mechanism; 1401. Octagonal storage cloth; 1402. Lifting hard board; 1403. Bearing cloth; 1404. Supporting ring; 1405. Bottom supporting plate; 1406. Cover plate; 1407. Cloth sleeve; 15. Teddy bear coat; 16. Teddy bear face mask; 17. Teddy bear footprint; 18. Piglet coat; 19. Piglet face mask; 20. Piglet footprint; 21. Puppy coat; 22. Puppy face mask; 23. Puppy footprint.

DETAILED DESCRIPTION OF THE EMBODIMENTS

The following will clearly and completely describe the technical solutions in the embodiments of the present invention in combination with the accompanying drawings in the embodiments of the present invention. Obviously, the described embodiments are only a part of the embodiments of the present invention, rather than all of them. Based on the embodiments of the present invention, all other embodiments obtained by ordinary technicians in the field without creative work fall within the protection scope of the present invention.

The following further describes the present invention in detail in combination with the drawings in the specification and the embodiments.

Embodiment 1

Figure 1:
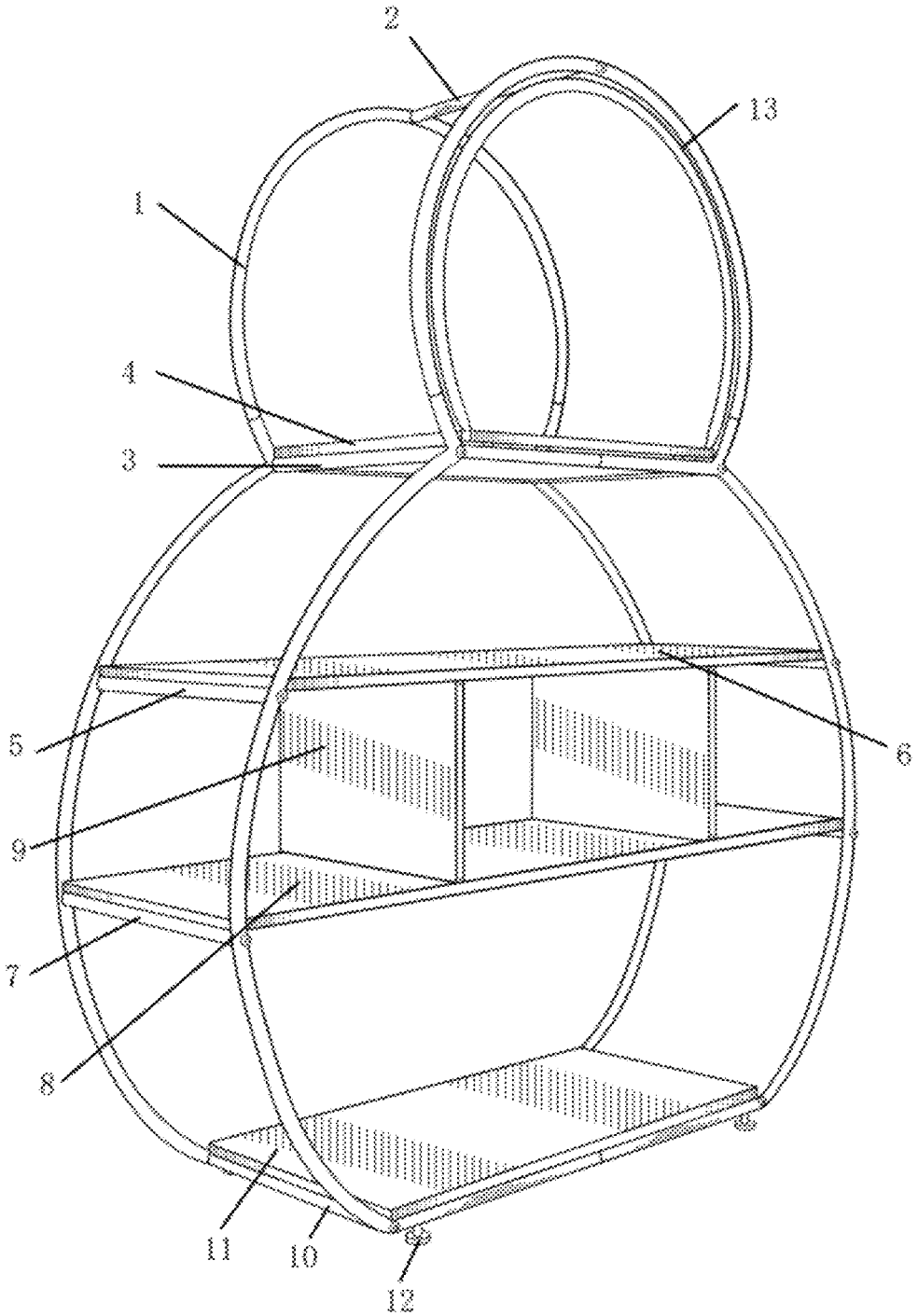
FIG. 1 is the schematic diagram of the three-dimensional structure of the present invention.
Figure 2:
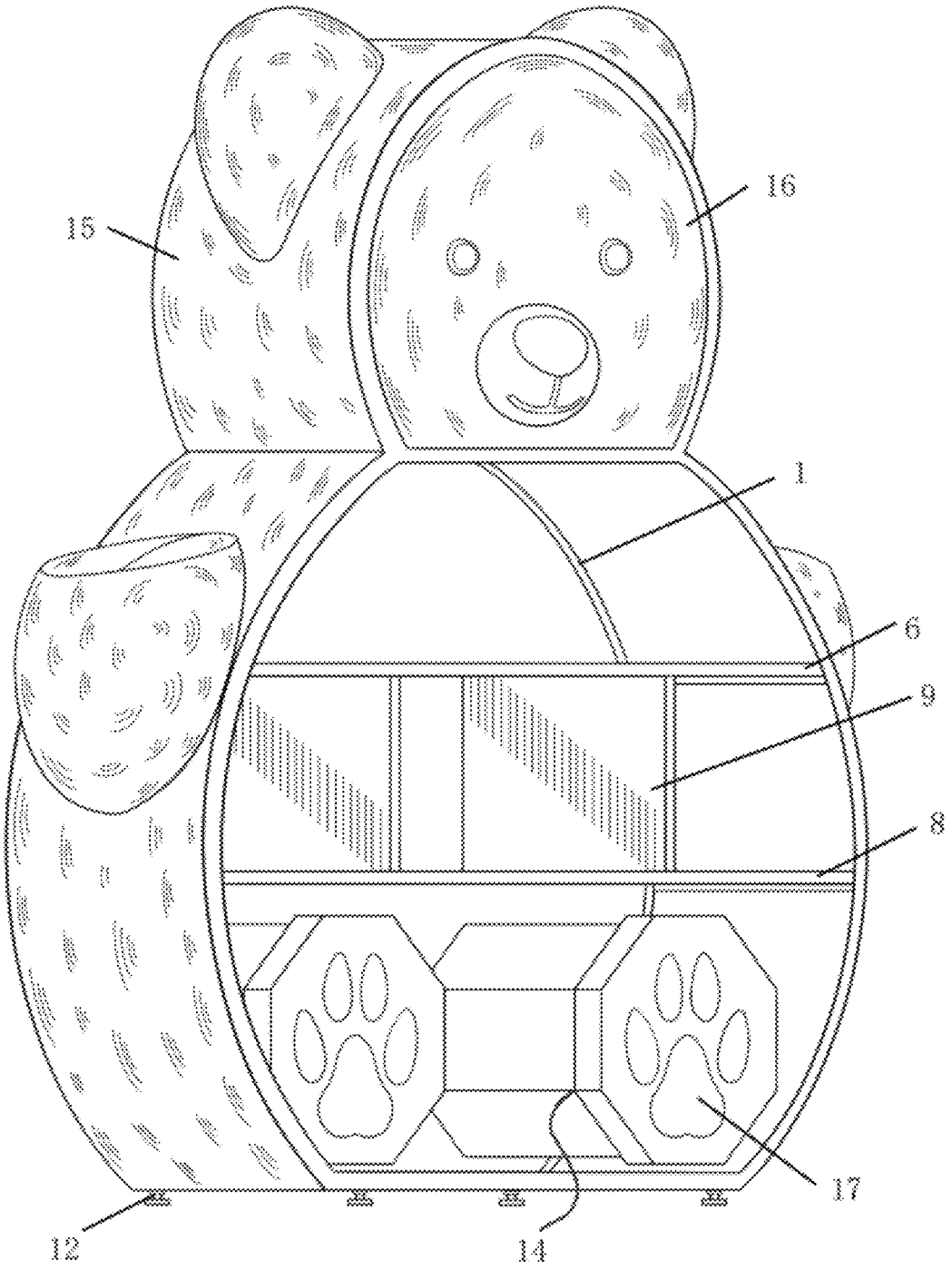
FIG. 2 is the schematic diagram of the three-dimensional structure of the teddy bear shape of the present invention.
Figure 3:
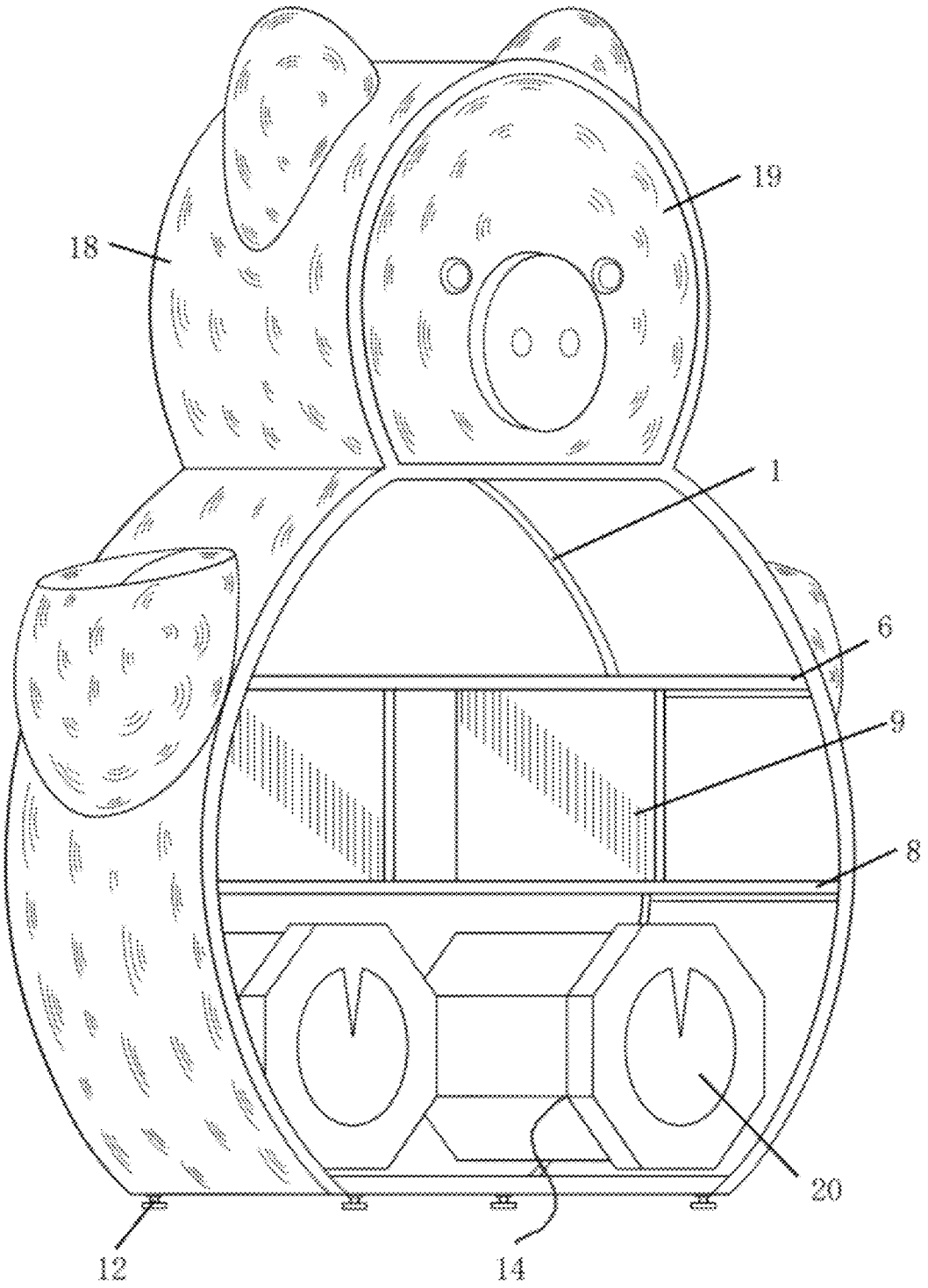
FIG. 3 is the schematic diagram of the three-dimensional structure of the piglet shape of the present invention.
Figure 4:
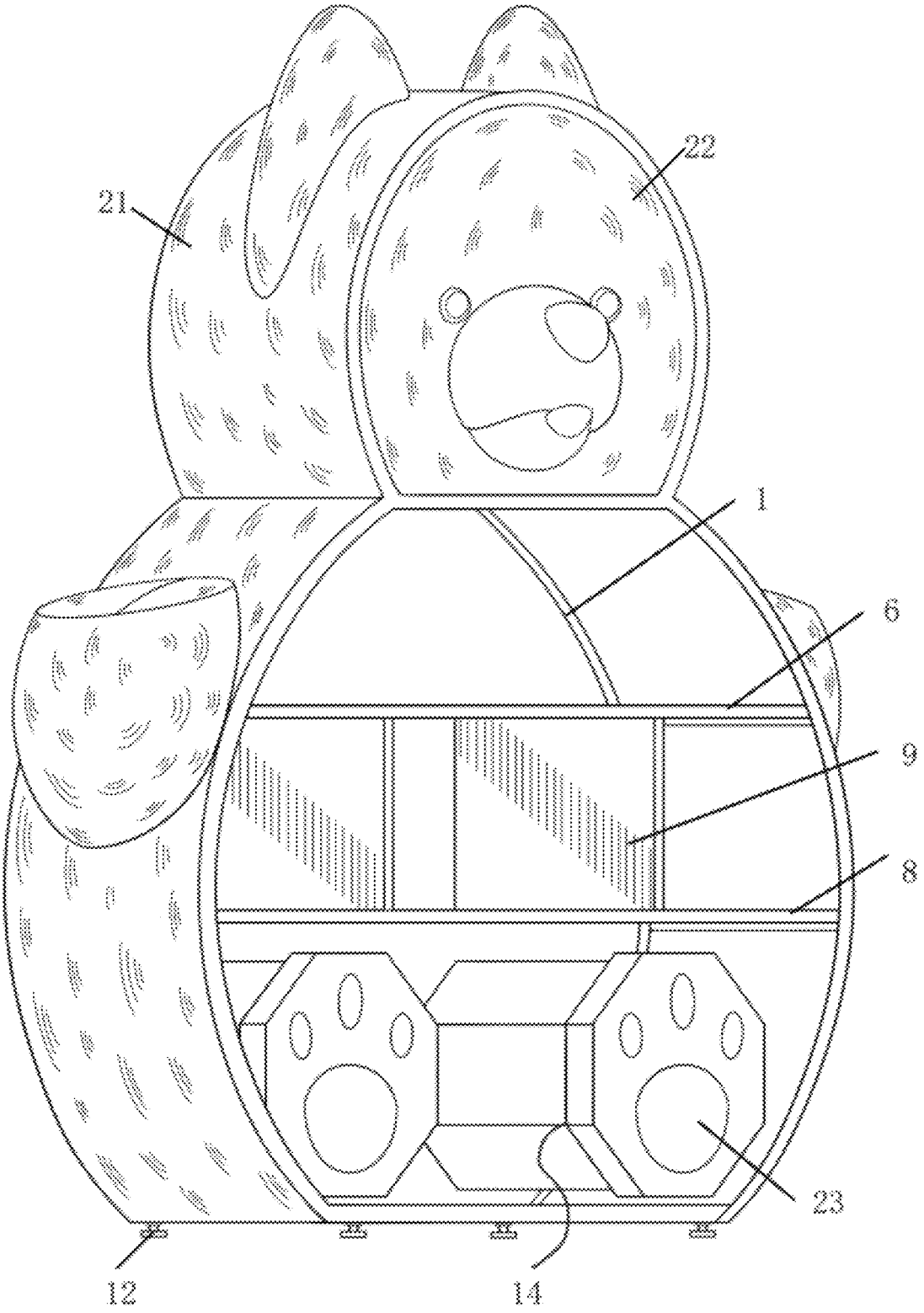
FIG. 4 is the schematic diagram of the three-dimensional structure of the puppy shape of the present invention.
Figure 5:
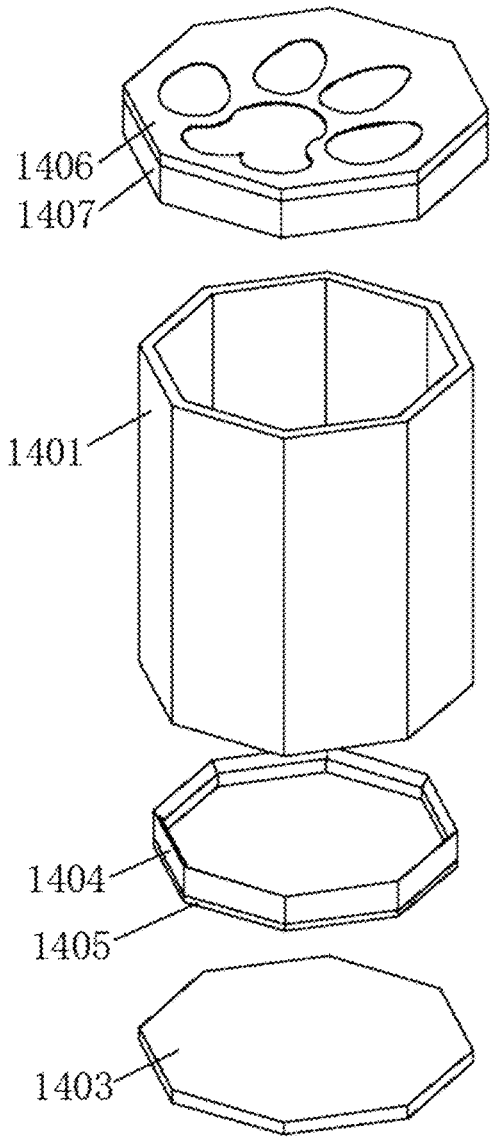
FIG. 5 is the schematic diagram of the exploded structure of the multi-functional storage mechanism of the present invention.
Figure 6:
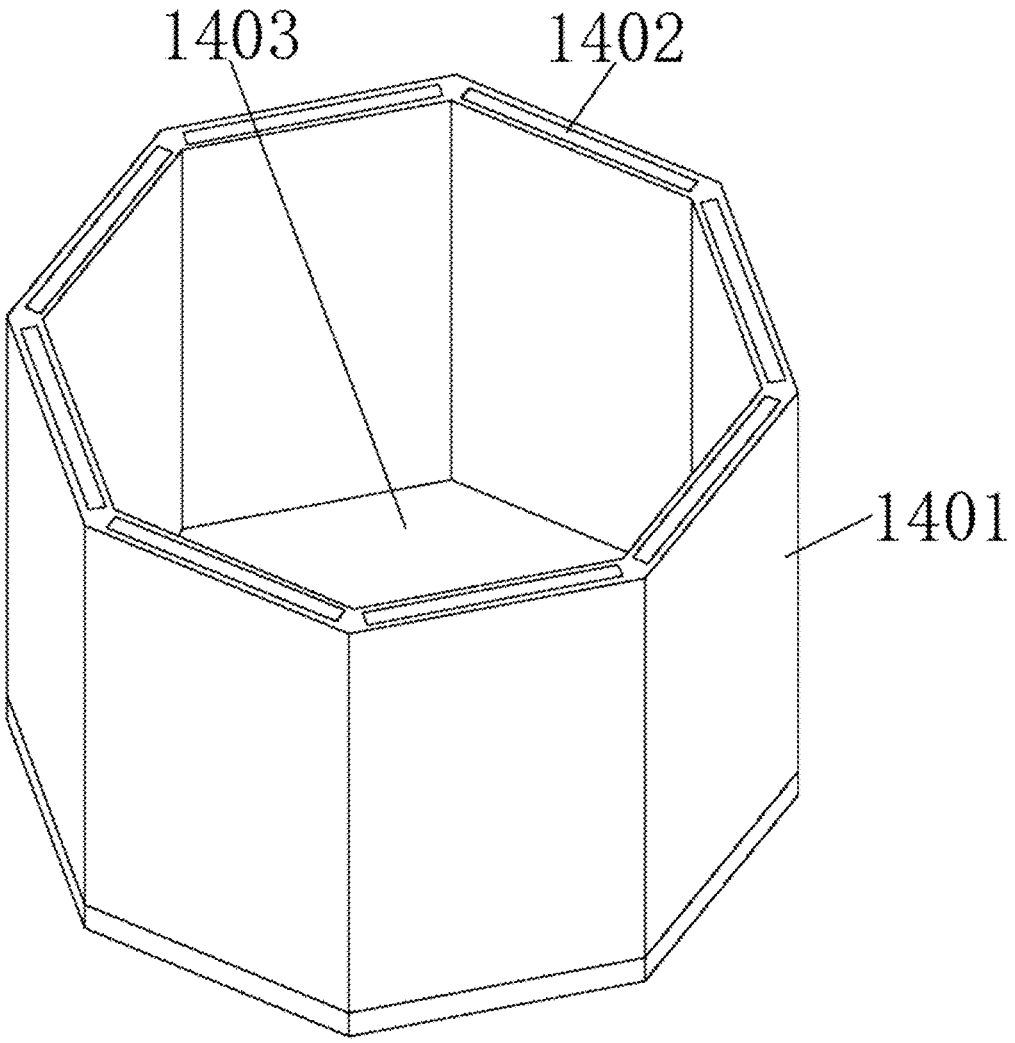
FIG. 6 is the sectional view of the internal structure of the octagonal storage cloth of the present invention.
Figure 7:
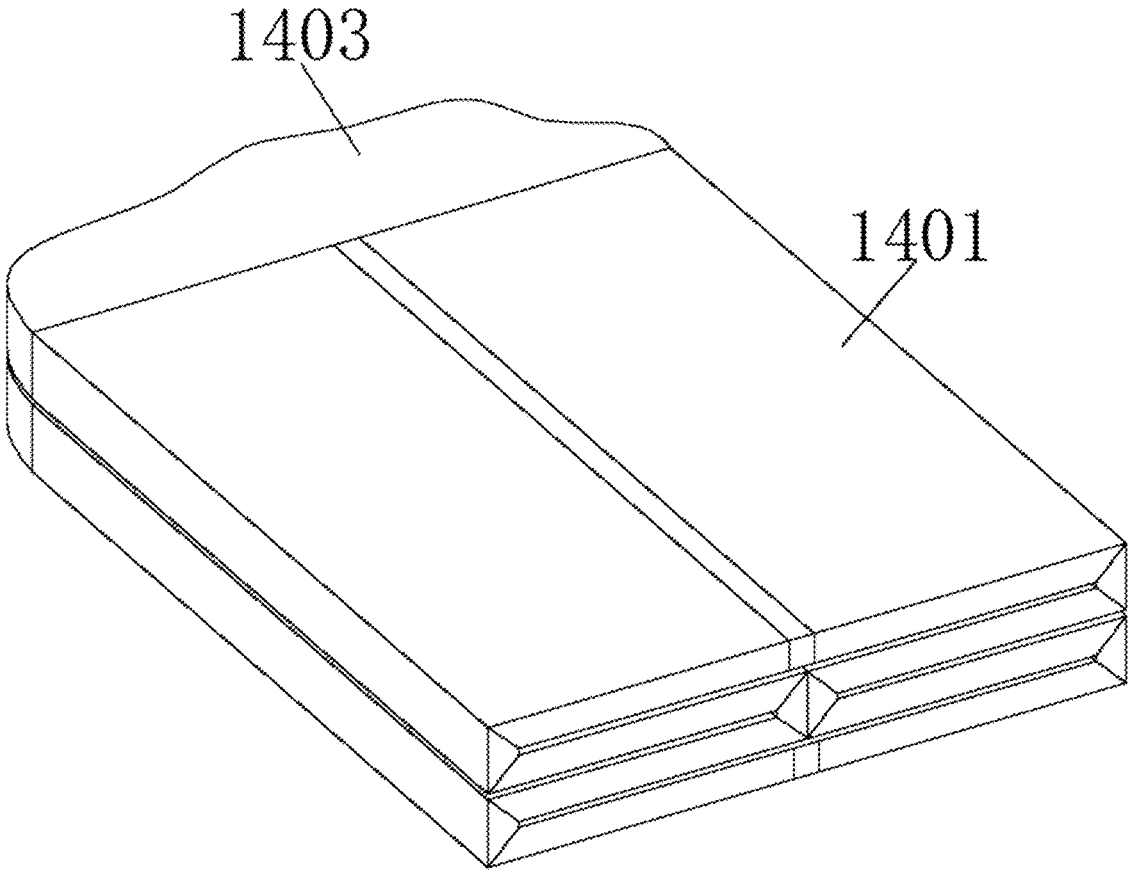
FIG. 7 is the schematic diagram of the folding and storing form of the octagonal storage cloth of the present invention.

As shown in FIGS. 1-7, a doll storage rack capable of changing shapes includes two main frames 1. The main frames 1 are designed with ergonomic dimensions, rounded corners without sharp angles, and a safe and stable structural design to ensure the safety and comfort of children during use.

The two main frames 1 are equipped with a top connecting rod 2, a first intermediate connecting rod 3, a second intermediate connecting rod 5, a third intermediate connecting rod 7, and a fourth intermediate connecting rod 10. The number of the first intermediate connecting rod 3, the second intermediate connecting rod 5, the third intermediate connecting rod 7, and the fourth intermediate connecting rod 10 is two respectively, and they are symmetrical about the center of the main frame 1. The top connecting rod 2, the first intermediate connecting rod 3, the second intermediate connecting rod 5, the third intermediate connecting rod 7, and the fourth intermediate connecting rod 10 are all connected to the two main frames 1 by bolts, enabling the whole device to be quickly assembled and facilitating transportation during moving.

A hidden placing plate 4, an upper placing plate 6, various types of placing plates 8, and a bottom placing plate 11 are arranged between the two main frames 1. By using the hidden placing plate 4, the upper placing plate 6, the various types of placing plates 8, and the bottom placing plate 11, it is convenient to carry books, toys, or other items that need to be stored.

Two multi-functional storage mechanisms 14 are placed on the upper surface of the bottom placing plate 11. The multi-functional storage mechanism 14 includes a cover plate 1406. The multi-functional storage mechanism 14 also includes an octagonal storage cloth 1401. Eight lifting hard boards 1402 are installed inside the octagonal storage cloth 1401. The bottom surface of the octagonal storage cloth 1401 is fixedly connected with a bearing cloth 1403. The eight lifting hard boards 1402 can play a supporting role when the octagonal storage cloth 1401 is placed vertically, and their main function is to bear the stress when a child sits.

The bottom surface of the cover plate 1406 is fixedly connected with a cloth sleeve 1406. The inner wall of the cloth sleeve 1407 is in contact with the outer surface of the octagonal storage cloth 1401. By using the cloth sleeve 1407, it is more convenient to position the cover plate 1406, making the cover plate 1406 more firmly sleeved on the outer surface of the octagonal storage cloth 1401.

The multi-functional storage mechanism 14 also includes a supporting ring 1404. The supporting ring 1404 is placed on the upper surface of the bearing cloth 1403. The bottom surface of the supporting ring 1404 is fixedly connected with a bottom supporting plate 1405. By using the cooperation between the supporting ring 1404 and the bottom supporting plate 1405, the bottom of the octagonal storage cloth 1401 can be reinforced, so that the octagonal storage cloth 1401 made of cloth can have stress support at its bottom.

Doll covers are sleeved on the outer surfaces of the two main frames 1. A reinforcing frame 13 is installed on the upper surface of the hidden placing plate 4. The set reinforcing frame 13 can reinforce the head of the doll cover.

Doll foot-shaped patterns are pasted on the outer surface of the cover plate 1406.

Preferably, two vertical partition plates 9 are fixedly connected to the upper surface of the various types of placing plates 8. Both of the two vertical partition plates 9 are fixedly connected to the bottom surface of the upper placing plate 6. By using the two vertical partition plates 9, the storage space between the upper placing plate 6 and the various types of placing plates 8 can be divided to better separate books or items. Two bottom feet 12 are fixedly connected to the bottom surfaces of the two main frames 1. By using the bottom feet 12, it can avoid the doll cover from directly contacting the ground. Its outer surface is prone to attaching dust and getting dirty.

The doll cover is a teddy bear coat 15, the doll foot-shaped pattern is teddy bear footprints 17, and the teddy bear coat 15 is connected with a teddy bear face mask 16 by magnetic blocks. The doll cover is a piglet coat 18, the doll foot-shaped pattern is piglet footprints 20, and the piglet coat 18 is connected with a piglet face mask 19 by magnetic blocks. The doll cover is a puppy coat 21, the doll foot-shaped pattern is puppy footprints 23, and the puppy coat 21 is connected with a puppy face mask 22 by magnetic blocks. The teddy bear coat 15 and the teddy bear face mask 16, the piglet coat 18 and the piglet face mask 19, and the puppy coat 21 and the puppy face mask 22 are all connected by magnetic blocks. This is an existing mature technology, which can conveniently open to place some items or toys that need to be hidden and stored above the hidden placing plate 4, form a private protection space for children, and is more beautiful.

The present invention also provides a usage method of the doll storage rack capable of changing shapes, which includes the following steps:

S1: Firstly, sleeve the teddy bear coat 15 on the outer surfaces of the two main frames 1, fasten it tightly with Velcro, align the magnetic blocks between the teddy bear coat 15 and the teddy bear face mask 16, and then place the multi-functional storage mechanism 14 with the teddy bear footprint 17 pattern on the bottom placing plate 11, thus completing the basic usage of the device.

S2: Users can sit on the upper surface of the cover plate 1406 to read. By removing the cover plate 1406 from the outer surface of the octagonal storage cloth 1401, sundries can be placed inside the octagonal storage cloth 1401.

S3: Remove the cover plate 1406 from the outer surface of the octagonal storage cloth 1401, then take out the supporting ring 1404 from inside the octagonal storage cloth 1401, and press the opposite edges of any symmetrical sides of the octagonal storage cloth 1401 relatively, so that the octagonal storage cloth 1401 can be folded and stored, saving space when not in use.

S4: Tear off the Velcro connecting the teddy bear coat 15, then separate the magnetic blocks between the teddy bear face mask 16 and the teddy bear coat 15, remove the teddy bear coat 15 from the outside of the two main frames 1, take the piglet coat 18 or the puppy coat 21 and sleeve it on the outer surfaces of the two main frames 1, and replace the cover plate 1406 on the outer surface of the octagonal storage cloth 1401 with one that has the corresponding piglet footprint 20 or puppy footprint 23 pattern, thus completing the shape change and enhancing the ornamental value of the storage rack.

The working principle of this embodiment is as follows: By separating the magnetic blocks between the teddy bear face mask 16 and the teddy bear coat 15, removing the Velcro on the teddy bear coat 15, and taking the teddy bear coat 15 off the outer surface of the main frame 1, the piglet coat 18 or the puppy coat 21 can be sleeved on the outer surface of the main frame 1, and the attached Velcro can be stuck, thus completing the change of the storage rack's shape. By removing the cover plate 1406 from the outer surface of the octagonal storage cloth 1401, the different cover plates 1406 with teddy bear footprint 17, piglet footprint 20, and puppy footprint 23 can be replaced, making the storage rack vivid and more ornamental. By removing the cover plate 1406 and the cloth sleeve 1407 from the outer surface of the octagonal storage cloth 1401, taking out the supporting ring 1406 and the bottom supporting plate 1405 from the inside of the octagonal storage cloth 1401, and then pressing the opposite edges of any symmetrical sides of the octagonal storage cloth 1401 relatively, the folding of the octagonal storage cloth 1401 can be completed, facilitating the storage of the octagonal storage cloth 1401 when it is not needed.

It should be noted that in this text, relational terms such as "first" and "second" are only used to distinguish one entity or operation from another entity or operation, and do not necessarily require or imply that there is any actual relationship or order between these entities or operations. Moreover, the terms "include", "comprise" or any other variants thereof are intended to cover non-exclusive inclusion, so that a process, method, article or device including a series of elements not only includes those elements, but also includes other elements that are not explicitly listed, or also includes elements inherent to such a process, method, article or device.

Although the embodiments of the present invention have been shown and described, for ordinary technicians in the field, it can be understood that various changes, modifications, replacements and variations can be made to these embodiments without departing from the principles and spirit of the present invention. The scope of the present invention is defined by the appended claims and their equivalents.

What is claimed is:

1. A doll storage rack capable of changing shapes, comprising two main frames (1) each having an outer surface configured to receive a doll cover, characterized in that: the two main frames (1) are equipped with a top connecting rod (2), a first intermediate connecting rod (3), a second intermediate connecting rod (5), a third intermediate connecting rod (7) and a fourth intermediate connecting rod (10); The number of the first intermediate connecting rod (3), the second intermediate connecting rod (5), the third intermediate connecting rod (7) and the fourth intermediate connecting rod (10) is two respectively, and they are symmetrical about the center of the main frame (1); A hidden placing plate (4), an upper placing plate (6), various types of placing plates (8) and a bottom placing plate (11) are arranged between the two main frames (1); A reinforcing frame (13) is installed on an upper surface of the hidden placing plate (4); Two multi-functional storage mechanisms (14) are placed on an upper surface of the bottom placing plate (11), and each of the multi-functional storage mechanisms (14) includes a cover plate (1406);

a doll cover is sleeved on outer surfaces of the two main frames (1);

a doll foot-shaped pattern is pasted on an outer surface of the cover plate (1406);

wherein each of the multi-functional storage mechanisms (14) further comprises an octagonal storage cloth (1401) and a supporting ring (1404); eight lifting hard boards (1402) are installed inside the octagonal storage cloth (1401); a bottom surface of the octagonal storage cloth (1401) is fixedly connected with a doll cloth; a bottom surface of the cover plate (1406) is fixedly connected with a cloth sleeve (1407); an inner wall of the cloth sleeve (1407) is in contact with an outer surface of the octagonal storage cloth (1401); the supporting ring (1404) is placed on an upper surface of the doll cloth, and a bottom surface of the supporting ring (1404) is fixedly connected with a bottom supporting plate (1405).

2. According to the doll storage rack capable of changing shapes as described in claim 1, characterized in that: Two vertical partition plates (9) are fixedly connected to upper surfaces of the various types of placing plates (8); Both of the two vertical partition plates (9) are fixedly connected to a bottom surface of the upper placing plate (6); Two bottom feet (12) are fixedly connected to bottom surfaces of the two main frames (1).

3. According to the doll storage rack capable of changing shapes as described in claim 1, characterized in that: The doll cover is a teddy bear coat (15), the doll foot-shaped pattern is teddy bear footprints (17), and the teddy bear coat (15) is connected with a teddy bear face mask (16) through magnetic blocks.

4. According to the doll storage rack capable of changing shapes as described in claim 1, characterized in that: The doll cover is a piglet coat (18), the doll foot-shaped pattern is piglet footprints (20), and the piglet coat (18) is connected with a piglet face mask (19) through magnetic blocks.

5. According to the doll storage rack capable of changing shapes as described in claim 1, characterized in that: The doll cover is a puppy coat (21), the doll foot-shaped pattern is puppy footprints (23), and the puppy coat (21) is connected with a puppy face mask (22) through magnetic blocks.

6. Usage Method of the Doll Storage Rack Capable of Changing Shapes Adopting the doll storage rack capable of changing shapes as described in claim 1, characterized by comprising the following steps:

S1: Firstly, sleeving a doll coat (15) on the outer surfaces of the two main frames (1), fastening it tightly with Velcro, aligning magnetic blocks connected between the doll coat (15) and a doll face mask (16), and then placing the multi-functional storage mechanism (14) with a doll footprint (17) pattern on the bottom placing plate (11);

S2: allowing a user to sit on an upper surface of the cover plate (1406) for reading; and removing the cover plate (1406) from an outer surface of an octagonal storage cloth (1401) to place sundries inside the octagonal storage cloth (1401);

S3: removing the cover plate (1406) from the outer surface of the octagonal storage cloth (1401), taking out a supporting ring (1404) from inside of the octagonal storage cloth (1401), and pressing opposite edges of any symmetrical sides of the octagonal storage cloth (1401) toward each other to fold and store the octagonal storage cloth (1401), thereby saving space when not in use;

S4: tearing off the Velcro connecting the doll coat (15), then separating the magnetic blocks between the doll face mask (16) and the doll coat (15), removing the doll coat (15) from the two main frames (1), sleeving a piglet coat (18) or a puppy coat (21) on the outer surfaces of the two main frames (1), and replacing the cover plate (1406) with a corresponding doll footprint pattern on the outer surface of the octagonal storage cloth (1401).

7. According to the doll storage rack capable of changing shapes as described in claim 1, characterized in that: the doll cover is a replaceable doll coat selected from a teddy bear coat (15), a piglet coat (18) and a puppy coat (21), and the replaceable doll coat is connected with a corresponding doll face mask through magnetic blocks.

* * * * *